US009830854B2

(12) United States Patent
Kim et al.

(10) Patent No.: US 9,830,854 B2
(45) Date of Patent: Nov. 28, 2017

(54) ORGANIC LIGHT EMITTING DISPLAY, DEVICE FOR SENSING THRESHOLD VOLTAGE OF DRIVING TFT IN ORGANIC LIGHT EMITTING DISPLAY, AND METHOD FOR SENSING THRESHOLD VOLTAGE OF DRIVING TFT IN ORGANIC LIGHT EMITTING DISPLAY

(71) Applicant: LG Display Co., Ltd., Seoul (KR)

(72) Inventors: Taegung Kim, Gyeonggi-do (KR); Junghyeon Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/189,403

(22) Filed: Jun. 22, 2016

(65) Prior Publication Data

US 2017/0004764 A1 Jan. 5, 2017

(30) Foreign Application Priority Data

Jun. 30, 2015 (KR) ..... 10-2015-0093654

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0842* (2013.01); *G09G 2310/0289* (2013.01); *G09G 2320/0233* (2013.01); *G09G 2320/0252* (2013.01);
(Continued)

(58) Field of Classification Search
CPC ..... G09G 3/3225; G09G 3/3233; G09G 2310/0289; G09G 2320/043; G09G 2320/0295; G09G 2320/0252; G09G 2300/0842; G09G 2320/0233
See application file for complete search history.

(56) References Cited

U.S. PATENT DOCUMENTS 8,462,100 B2 * 6/2013 Umezaki ..... G09G 3/342 345/100
8,482,493 B2 * 7/2013 Yamazaki ..... G09G 3/3258 345/76

(Continued)

OTHER PUBLICATIONS

Extended European Search Report dated Sep. 13, 2016 in corresponding to EP Application 16176788.4.

*Primary Examiner* — Andrew Sasinowski
(74) *Attorney, Agent, or Firm* — Morgan, Lewis & Bockius LLP

(57) ABSTRACT

A device for sensing a threshold voltage of a driving TFT in an organic light emitting display includes a data drive circuit and a timing controller. The data drive circuit applies a data voltage to a gate node of the driving TFT during a first programming period, determines a source node voltage of the driving TFT as a first sensing voltage during a first sensing period in which a gate-source voltage is constant and higher than the threshold voltage, applies another data voltage to the gate node during a second programming period, and determines the source node voltage as a second sensing voltage during a second sensing period in which the gate-source voltage is constant and higher than the threshold voltage. The timing controller calculates a ratio between the first and second sensing voltages, and obtains a change in the threshold voltage using a change in the ratio.

17 Claims, 11 Drawing Sheets

(52) U.S. Cl.
CPC ..... *G09G 2320/0295* (2013.01); *G09G 2320/043* (2013.01)

(56) References Cited

U.S. PATENT DOCUMENTS

| | | | | |
|---|---|---|---|---|
| 8,766,906 | B2 * | 7/2014 | Yoshida | G09G 3/20 345/100 |
| 8,810,486 | B2 * | 8/2014 | Yumoto | G09G 3/3283 315/169.1 |
| 2008/0074413 | A1 | 3/2008 | Ogura | |
| 2010/0039422 | A1 | 2/2010 | Seto | |
| 2011/0032264 | A1 * | 2/2011 | Ietomi | G09G 3/3233 345/559 |
| 2011/0205250 | A1 | 8/2011 | Yoo et al. | |
| 2013/0162617 | A1 * | 6/2013 | Yoon | G09G 3/3291 345/211 |
| 2013/0169702 | A1 * | 7/2013 | Ono | G09G 5/10 345/690 |
| 2015/0077615 | A1 * | 3/2015 | Yamazaki | G09G 3/3233 348/333.01 |

* cited by examiner

ORGANIC LIGHT EMITTING DISPLAY, DEVICE FOR SENSING THRESHOLD VOLTAGE OF DRIVING TFT IN ORGANIC LIGHT EMITTING DISPLAY, AND METHOD FOR SENSING THRESHOLD VOLTAGE OF DRIVING TFT IN ORGANIC LIGHT EMITTING DISPLAY

This application claims the priority benefit of Korean Patent Application No. 10-2015-0093654 filed on Jun. 30, 2015, which is hereby incorporated herein by reference for all purposes as if fully set forth herein.

BACKGROUND

Field of the Invention

The present invention relates to an organic light emitting display, and more particularly, to an organic light emitting display including a device for sensing the threshold voltage of a driving TFT and a method for sensing the threshold voltage of a driving TFT in an organic light emitting display.

Discussion of the Related Art

An active-matrix organic light emitting display comprises organic light emitting diodes (OLEDs) that are self-luminous (i.e., emit light themselves). An active-matrix organic light emitting display has advantages including fast response time, high luminous efficiency, high luminance, and wide viewing angle. An OLED comprises an anode and a cathode, as well as organic compound layers HIL, HTL, EML, ETL, and EIL formed between the anode and cathode. The organic compound layers comprise a hole injection layer HIL, a hole transport layer HTL, an emission layer EML, an electron transport layer ETL, and an electron injection layer EIL. When an operating voltage is applied to the anode and the cathode, a hole passing through the hole transport layer HTL and an electron passing through the electron transport layer ETL move to the emission layer EML, thereby forming an exciton. As a result, the emission layer EML generates visible light.

In an organic light emitting diode display, pixels each comprising an organic light emitting diode are arranged in a matrix, and the luminance of the pixels is adjusted based on the grayscale of video data. Each individual pixel comprises a driving TFT (thin-film transistor) that controls the drive current flowing through the OLED. The electrical characteristic of the driving TFT, such as threshold voltage, mobility, etc., may vary from pixel to pixel because of the process condition, driving environment, etc. Such variation in the electrical characteristics of the driving TFT causes luminance differences between the pixels. As a solution to this problem, a technology that senses the characteristic parameters (threshold voltage, mobility, etc.) of the driving TFT of each pixel and corrects image data based on the sensing results is known.

In the related art, as shown in FIG. 1, a driving TFT DT is operated according to a source follower method, and then the source node voltage Vs of the driving TFT DT is detected as a sensing voltage Vsen at the time to when the gate-source voltage Vgs of the driving TFT DT reaches saturation state by an electric current flowing through the driving TFT DT, thereby sensing a change in the threshold voltage Vth of the driving TFT DT. However, a long period of time is needed for the gate-source voltage Vgs of the driving TFT DT to reach the threshold voltage Vth of the driving TFT DT. Accordingly, in the related art, it is not possible to sense a change in the threshold voltage Vth of the driving TFT DT during real-time operation.

SUMMARY

Accordingly, the present invention is directed to an organic light emitting display, a device for sensing a threshold voltage of a driving TFT in an organic light emitting display, and a method for sensing a threshold voltage of a driving TFT in an organic light emitting display that substantially obviate one or more of the problems due to limitations and disadvantages of the related art.

An object of the present invention is to provide a device and method for sensing the threshold voltage of a driving TFT in an organic light emitting display so that a change in the threshold voltage of the driving TFT is sensed during real-time operation by reducing sensing time.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device for sensing a threshold voltage of a driving TFT in an organic light emitting display comprises a data drive circuit configured to apply a first data voltage to a gate node of the driving TFT during a first programming period, determine a source node voltage of the driving TFT as a first sensing voltage during a first sensing period in which a gate-source voltage of the driving TFT is held constant at a first value higher than the threshold voltage of the driving TFT, apply a second data voltage to the gate node of the driving TFT during a second programming period, and determine the source node voltage of the driving TFT as a second sensing voltage during a second sensing period in which the gate-source voltage of the driving TFT is held constant at a second value higher than the threshold voltage of the driving TFT; and a timing controller configured to calculate a sensing ratio based on a ratio between the first and second sensing voltages, calculate a change in the sensing ratio by comparing the calculated sensing ratio with a predetermined initial sensing ratio, and then obtain a change in the threshold voltage of the driving TFT based on the change in the sensing ratio.

In another aspect, a method for sensing threshold voltage of a driving TFT in organic light emitting display comprises applying a first data voltage for sensing to a gate node of the driving TFT during a first programming period; determining a source node voltage of the driving TFT as a first sensing voltage during a first sensing period in which a gate-source voltage of the driving TFT is held constant at a first value higher than the threshold voltage of the driving TFT; applying a second data voltage to the gate node of the driving TFT during a second programming period; determining the source node voltage of the driving TFT as a second sensing voltage during a second sensing period in which the gate-source voltage of the driving TFT is held constant at a second value higher than the threshold voltage of the driving TFT; calculating a sensing ratio based on a ratio between the first and second sensing voltages; calculating a change in sensing ratio by comparing the calculated sensing ratio with a predetermined initial sensing ratio; obtaining a change in the threshold voltage of the driving TFT based on the change in sensing ratio; and adjusting image data output from the data drive circuit to a pixel driven by the driving TFT in the organic light emitting display device based on the change in the threshold voltage to correct an amount of light emitted by the pixel.

In another aspect, an organic light emitting display comprises a display panel including a plurality of pixels, each pixel having an organic light emitting diode (OLED) to emit light and a driving TFT to control an amount of light emitted by the OLED; a data drive circuit configured to apply a first data voltage to a gate node of the driving TFT during a first programming period, determine a source node voltage of the driving TFT as a first sensing voltage during a first sensing period in which a gate-source voltage of the driving TFT is held constant at a first value higher than the threshold voltage of the driving TFT, apply a second data voltage to the gate node of the driving TFT during a second programming period, and determine a source node voltage of the driving TFT as a second sensing voltage during a second sensing period in which the gate-source voltage of the driving TFT is held constant at a second value higher than the threshold voltage of the driving TFT; and a timing controller configured to calculate a sensing ratio based on the ratio between the first and second sensing voltages, calculate a change in the sensing ratio by comparing the calculated sensing ratio with a predetermined initial sensing ratio, and then obtain a change in the threshold voltage of the driving TFT based on the change in the sensing ratio, wherein the data drive circuit is configured to adjust image data output from the data drive circuit to a pixel driven by the driving TFT based on the change in the threshold voltage to correct an amount of light emitted by the pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
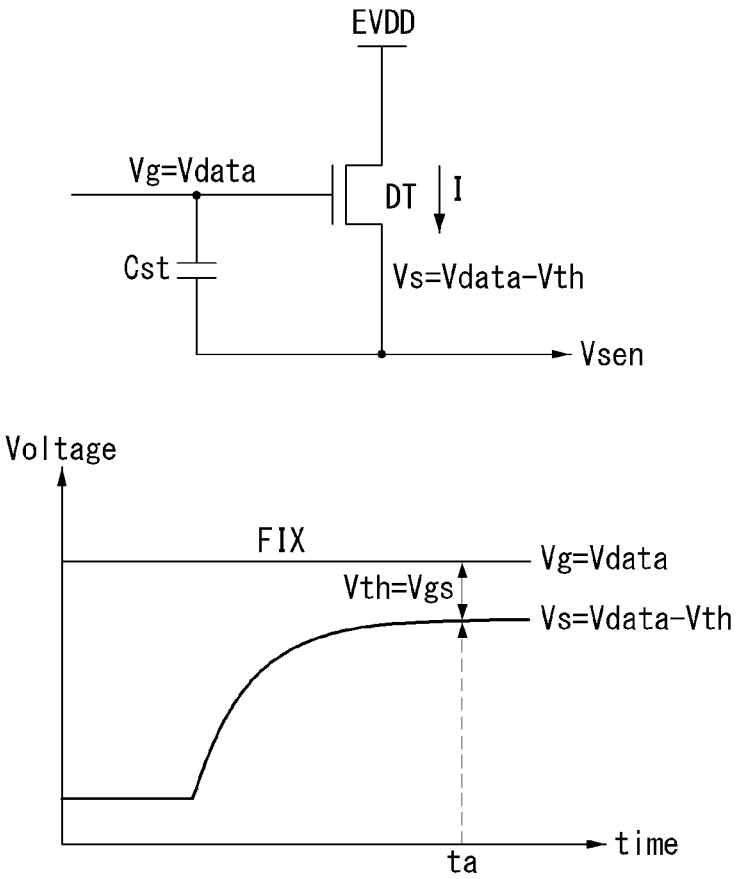
FIG. 1 (RELATED ART)
FIG. 1 is a view showing a related art technology for sensing the threshold voltage of a driving TFT according to a source follower method.
Figure 2:
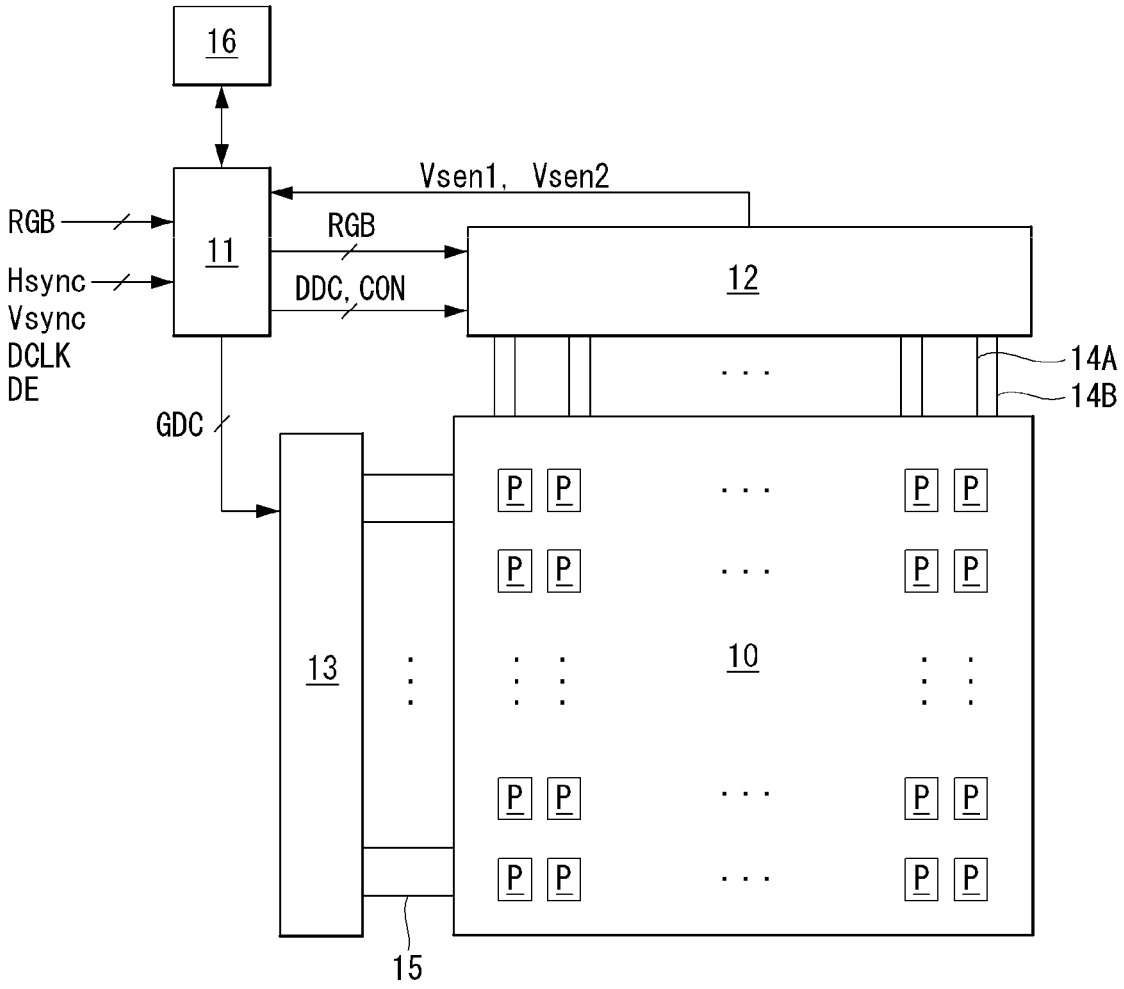
FIG. 2 is a view schematically showing an organic light emitting display according to an example embodiment of the present invention.
Figure 3:
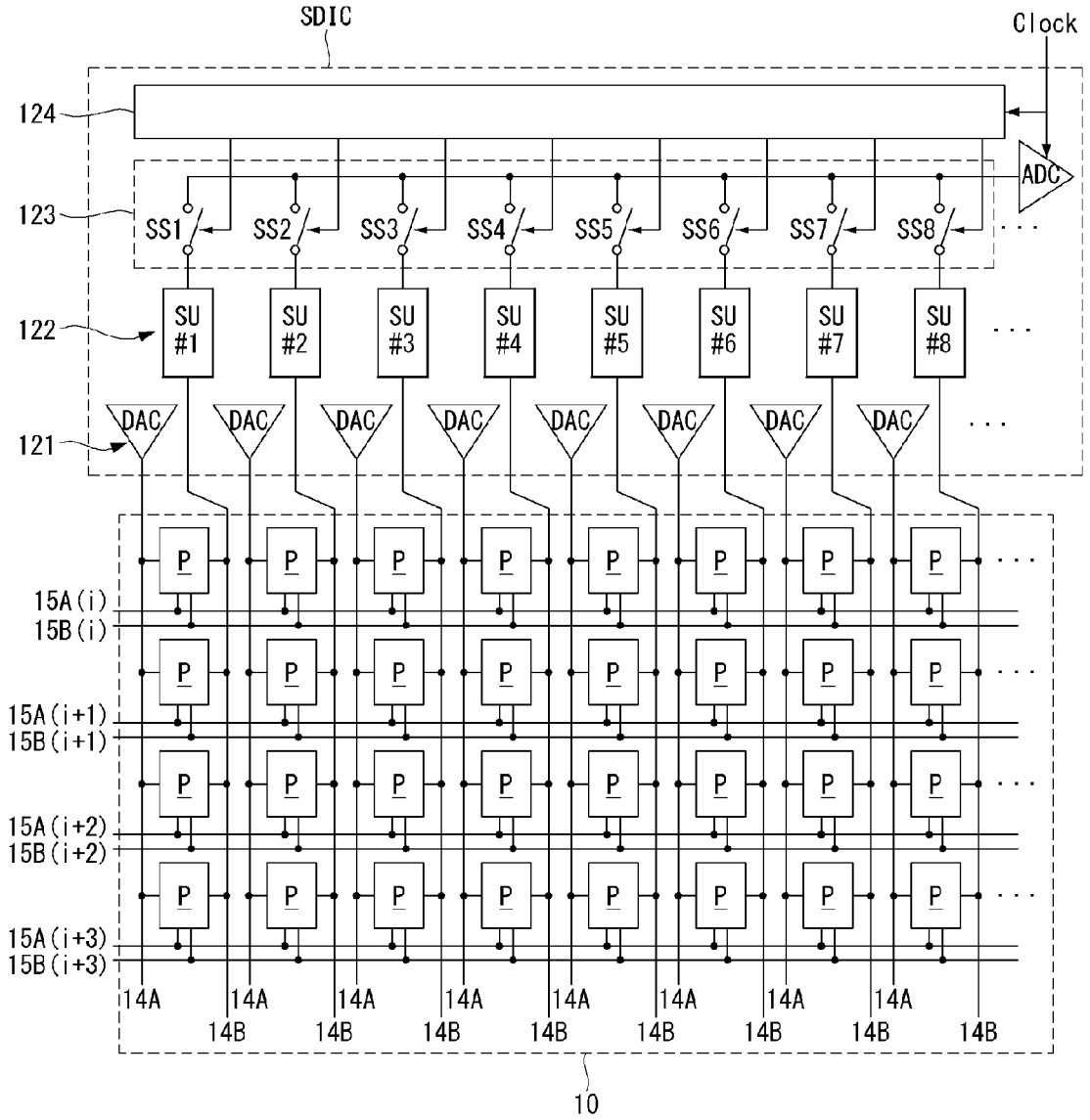
FIG. 3 is a view showing an example of the configuration of a pixel array and a data driver IC.
Figure 4:
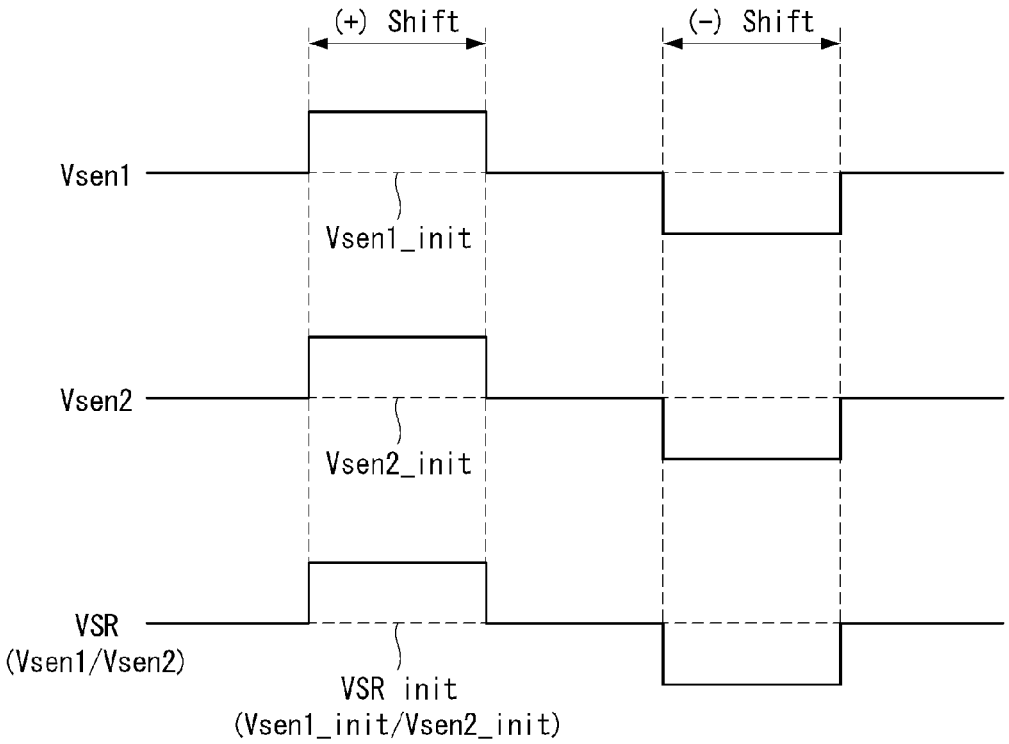
FIG. 4 is a view showing the principle for deducing a change in the threshold voltage of the driving TFT based on a sensing ratio.

Hereinafter, example embodiments of the present invention will be described in detail with reference to the accompanying drawings. Throughout the specification, like numbers refer to like elements. In describing the present invention, when it is deemed that a detailed description of known functions or configurations may unnecessarily obscure the subject matter of the present invention, the detailed description will be omitted FIG. 2 is a view schematically showing an organic light emitting display according to an example embodiment of the present invention. FIG. 3 is a view showing an example of the configuration of a pixel array and a data driver IC. FIG. 4 is a view showing the principle for deriving a change in the threshold voltage of the driving TFT based on a sensing ratio.

As shown in FIGS. 2 and 3, an organic light emitting display according to an example embodiment of the present invention may comprise a display panel 10, a timing controller 11, a data drive circuit 12, a gate drive circuit 13, and a memory 16. A plurality of data lines and sensing lines 14A and 14B and a plurality of gate lines 15 intersect each other on the display panel 10, and pixels P are arranged in a matrix at the intersections. The gate lines 15 comprise a plurality of first gate lines 15A sequentially supplied with a scan control signal (SCAN of FIG. 5) and a plurality of second gate lines 15B sequentially supplied with a sensing control signal (SEN of FIG. 5).

Each pixel P may be connected to any one of the data lines 14A, any one of the sensing lines 14B, any one of the first gate lines 15A, and any one of the second gate lines 15B. Each pixel P may be connected to a data line 14A in response to a scan control signal SCAN input through a first gate line 15A, and may be connected to a sensing line 14B in response to a sensing control signal SEN input through a second gate line 15B.

Each pixel P is supplied with a high-level operating voltage ELVD and a low-level operating voltage ELVSS from a power generator (not shown). Each pixel P may comprise an OLED and a driving TFT that drives the OLED. The driving TFT may be implemented as p-type or n-type. Also, a semiconductor layer of the driving TFT may comprise amorphous silicon, polysilicon, or oxide.

Each pixel P displays an image, and may operate differently in an image display operation for internally compensating for a change in the mobility of the driving TFT and in a compensation operation for sensing and compensating for a change in the threshold voltage of the driving TFT. The compensation operation may be performed for a predetermined amount of time during power-on or power-off. Particularly, the compensation operation may reduce the time taken to sense a change in the threshold voltage of the driving TFT by a method to be described later. Thus, it is possible to sense a change in the threshold voltage of the driving TFT during vertical blanking intervals of a real-time operation, that is, image display operation.

The image display operation and the compensation operation may be implemented depending on the operation of the data drive circuit 12 and gate drive circuit 13 under the control of the timing controller 11.

The data drive circuit 12 comprises at least one data driver IC (integrated circuit) SDIC. The data driver IC (SDIC) may comprise a plurality of digital-to-analog converters (DAC) 121 connected to data lines 14A, a plurality of sensing units 122 connected to sensing lines 14B, a MUX 123 that selectively connects the sensing units 122 to an analog-to-digital converter (ADC), and a shift register 124 that generates a selection control signal and sequentially turns on switches SS1 to SSk in the MUX 123.

In the compensation operation, the DACs 121 generate a data voltage for sensing and supply it to the data lines 14A, under the control of the timing controller 11. In the image display operation, the DACs 121 generate a data voltage for image display and supply it to the data lines 14A, under the control of the timing controller 11.

The sensing units SU#1 to SU#k may be connected to the sensing lines 14B on a one-to-one basis. The sensing units SU#1 to SU#k may supply a reference voltage to the sensing lines 14B or read a sensing voltage stored in the sensing lines 14B and supply it to the ADC, under the control of the timing controller 11. The ADC converts a sensing voltage selectively input through the MUX 123 to a digital value and transmits it to the timing controller 11.

The gate drive circuit 13 may generate a scan control signal corresponding to the image display operation or compensation operation and then supply it to the first gate lines 15A line by line, under the control of the timing controller 11. The gate drive circuit 13 generates a sensing control signal corresponding to the image display operation or compensation operation and then supplies it to the second gate lines 15B line by line, under the control of the timing controller 11.

The timing controller 11 generates a data control signal DDC for controlling the operation timing of the data drive circuit 12 and a gate control signal GDC for controlling the operation timing of the gate drive circuit 131 based on timing signals, such as a vertical synchronization signal Vsync, a horizontal synchronization signal Hsync, a dot clock signal DCLK, and a data enable signal DE. The timing controller 11 may differentiate between the image display operation and the compensation operation based on a predetermined reference signal (a driving power enable signal, a vertical synchronization signal, a data enable signal, etc.), and generate a data control signal DDC and gate control signal GDC corresponding to each of the image display operation and compensation operation. Moreover, the timing controller 11 may further generate relevant switching control signals CON (including PRE and SAM of FIG. 5) to operate internal switches in each sensing unit SU#1 to SU#k for the image display operation and compensation operation.

As shown in FIG. 4, the timing controller 11 obtains a first sensing voltage Vsen1 and a second sensing voltage Vsen2 by sensing a change in the threshold voltage of the driving TFT twice for each pixel, and obtains a change in the threshold voltage of the driving TFT based on the sensing ratio VSR between the first and second sensing voltages Vsen1 and Vsen2. In FIG. 4, Vsen1_init indicates a first initial sensing voltage of when a first data voltage for sensing is applied, and Vsen2_init indicates a second initial sensed voltage of when a second data voltage for sensing is applied. VSRinit is an initial sensing ratio, which is equal to the first initial sensing voltage Vsen1_init divided by the second initial sensing voltage Vsen2_init. The initial sensing ratio VSRinit may vary depending on the product model and specification, and is preset at the time of product release and stored in the internal memory of the display device.

When there is a change in the threshold voltage of the driving TFT due to driving stress, different sensing data voltages may be applied to each pixel, and the source node voltage of the driving TFT may be acquired as the first and second sensing voltages while the gate-source voltage of the driving TFT is higher than the threshold voltage of the driving TFT. The first and second sensing voltages comprise a change in the mobility of the driving TFT, as well as a change in the threshold voltage of the driving TFT. Thus, by calculating the sensing ratio between the first and second sensing voltages, the change in the mobility of the driving TFT commonly included in the first and second sensing voltages may be canceled out, and only the change in the threshold voltage of the driving TFT may be obtained. In the related art, the source node voltage of the driving TFT is sensed at the timing when the gate-source voltage of the driving TFT is saturated at the threshold voltage of the driving TFT. This means that the sensing requires a very long time, making it impossible to sense a change in the threshold voltage of the driving TFT during a vertical blanking interval in the image display operation. However, if the sensing is done while the gate-source voltage of the driving TFT is higher than the threshold voltage of the driving TFT, as in example embodiments of the present invention, the total time taken for the sensing is reduced to 1/10 as compared to that of the related art even if the sensing is done twice. Accordingly, a change in the threshold voltage of the driving TFT can be adequately sensed during the vertical blanking interval in the image display operation.

In the compensation operation, the timing controller 11 calculates an nth sensing ratio (n is a positive integer) based on the ratio between the first and second sensing voltages, calculates a change in sensing ratio by comparing the nth sensing ratio with a preset initial sensing ratio, and then obtains a change in the threshold voltage based on the change in sensing ratio. The timing controller 11 may properly update an (n−1)th compensation value stored in the memory 16 based on the obtained threshold voltage change.

In the compensation operation, the timing controller 11 may transmit first and second compensation data corresponding to the first and second data voltage for sensings to the data drive circuit 12. Here, the first and second compensation data reflects the change in the threshold voltage of the driving TFT that was sensed in the previous sensing period. In the image display operation, the timing controller 11 may transmit image data RGB corresponding to the image display data voltage. Here, the image data RGB may be modulated in such a way as to compensate for the change in the threshold voltage of the driving TFT that was sensed in the previous sensing period.

Figure 5:
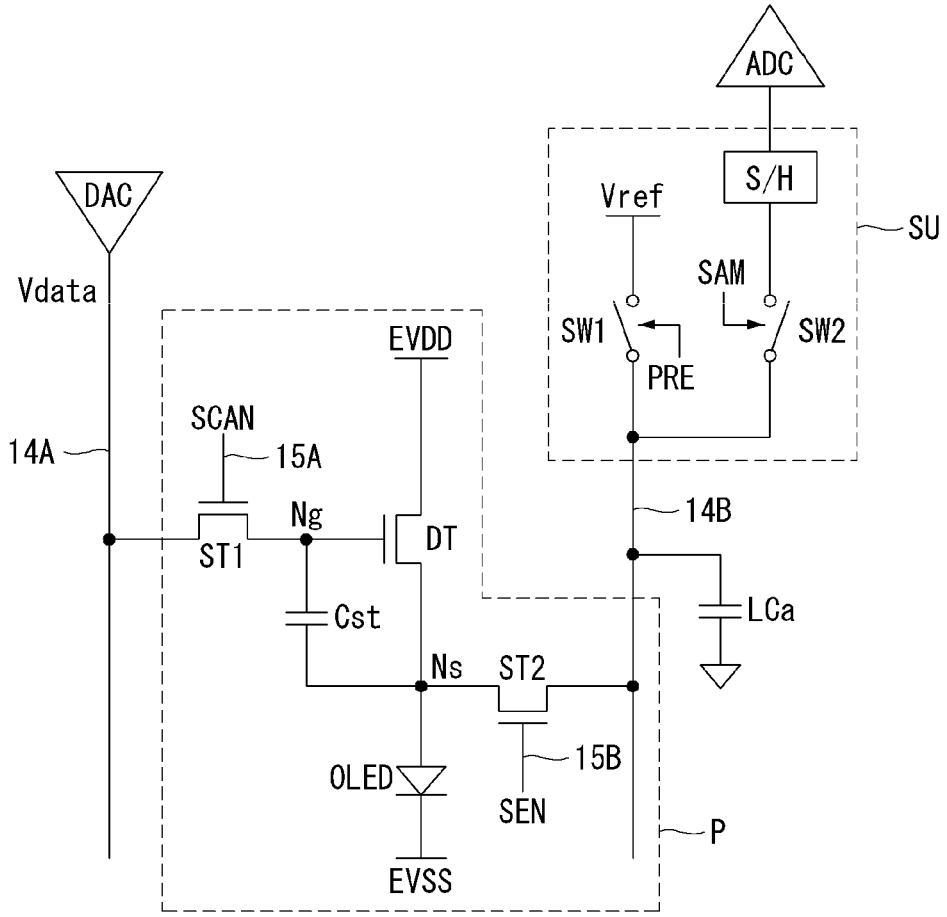
FIG. 5 is a circuit diagram showing detailed configurations of a pixel and a sensing unit according to an example embodiment of the present invention.
Figure 6:
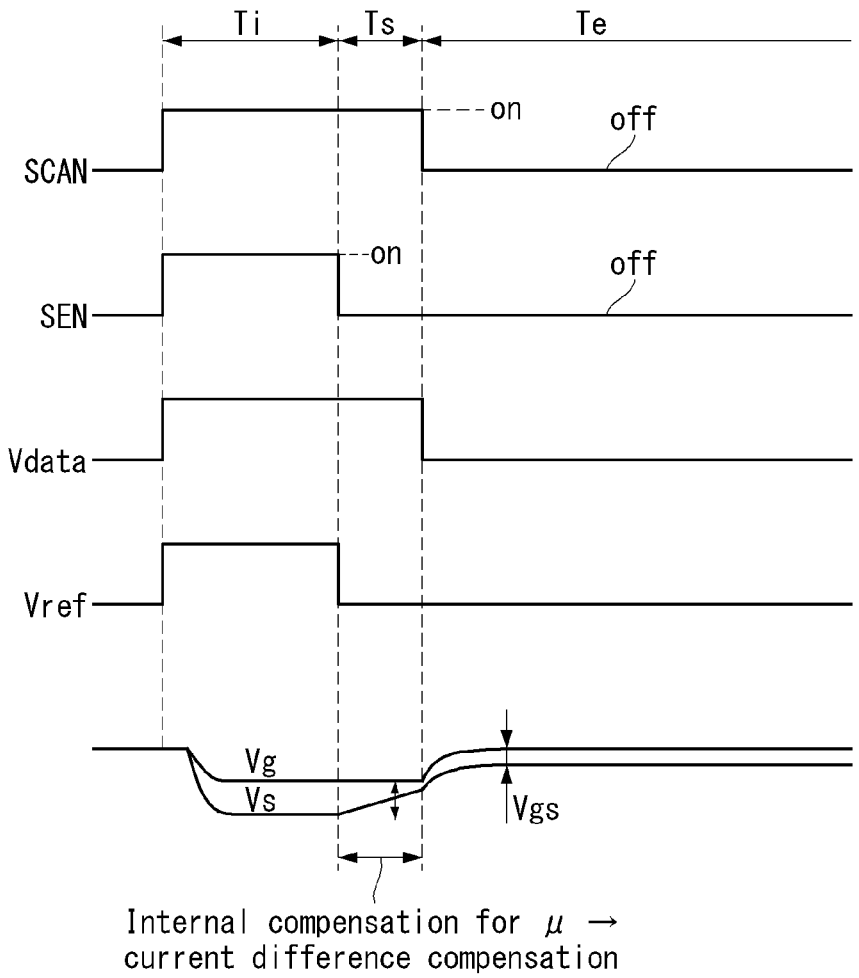
FIG. 6 is a waveform diagram showing the compensation of a change in the mobility of the driving TFT according to an example embodiment of the present invention.
Figure 7A:
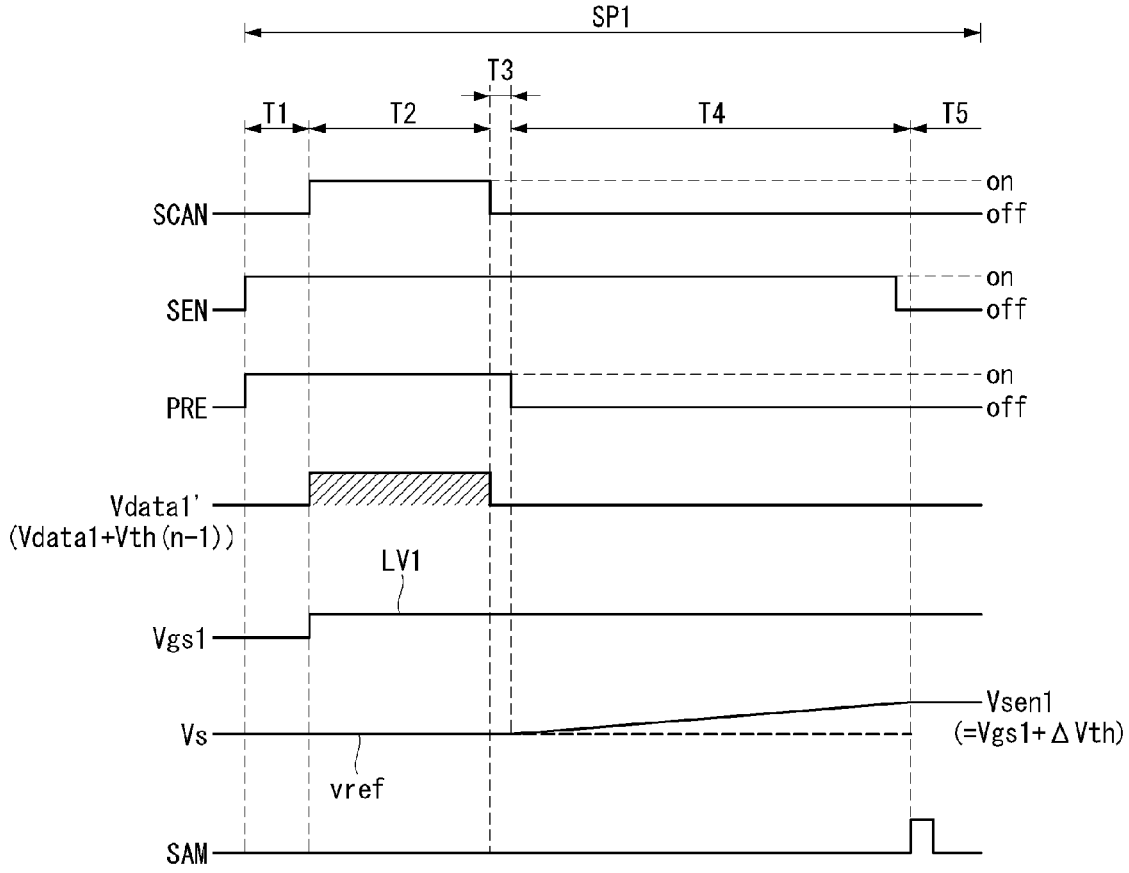
FIGS. 7A and 7B are waveform diagrams showing a process of sensing a change in the threshold voltage of the driving TFT according to an example embodiment of the present invention.
Figure 7B:
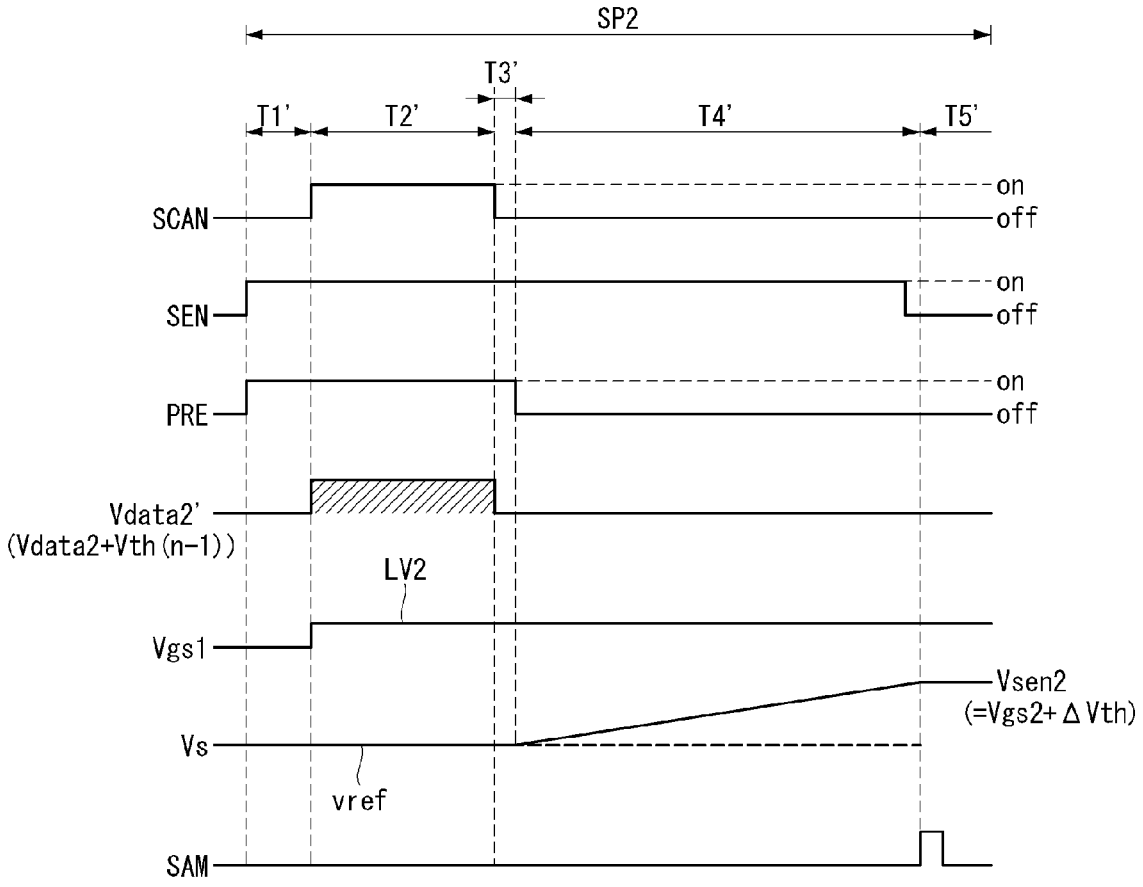
Figure 8:
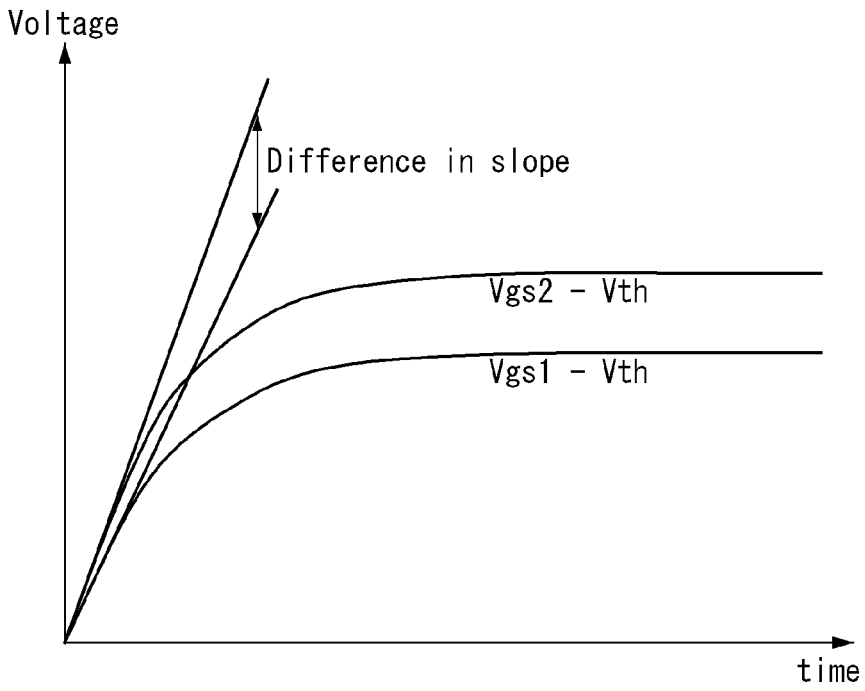
FIG. 8 is a view showing that the change in the threshold voltage of the driving TFT appears as the difference in slope between the curves in the TFT linear region.

FIG. 5 shows detailed configurations of a pixel and a sensing unit according to an example embodiment of the present invention. FIG. 6 shows the compensation of a change in the mobility of the driving TFT according to an example embodiment of the present invention. FIGS. 7A and 7B show a process of sensing a change in the threshold voltage of the driving TFT according to an example embodiment of the present invention. FIG. 8 shows that the change in the threshold voltage of the driving TFT appears as the difference in slope between the curves in the TFT linear region.

With reference to FIG. 5, a pixel P may comprise an OLED, a driving TFT (thin film transistor) DT, a storage capacitor Cst, a first switching TFT ST1, and a second switching TFT ST2.

The OLED comprises an anode connected to a source node Ns, a cathode connected to an input terminal of a low-level operating voltage EVSS, and an organic compound layer positioned between the anode and the cathode.

The driving TFT DT controls the amount of current input into the OLED based on a gate-source voltage Vgs. The driving TFT DT comprises a gate electrode connected to a gate node Ng, a drain electrode connected to an input terminal of a high-level operating voltage EVDD, and a source electrode connected to the source node Ns. The storage capacitor Cst is connected between the gate node Ng and the source node Ns to maintain the gate-source voltage Vgs of the driving TFT DT. The first switching TFT ST1 applies a sensing data voltage Vdata on a data line 14A to the gate node Ng in response to a scan control signal SCAN. The first switching TFT ST1 comprises a gate electrode connected to the first gate line 15A, a drain electrode connected to the data line 14A, and a source electrode connected to the gate node Ng. The second switching TFT ST2 switches on an electrical connection between the source node Ns and a sensing line 14B in response to a sensing control signal SEN. The second switching TFT ST2 comprises a gate electrode connected to a second gate line 15B, a drain electrode connected to the sensing line 14B, and a source node connected to the source node Ns.

Also, a sensing unit SU may comprise a reference voltage control switch SW1, a sampling switch SW2, and a sample and hold circuit S/H. The reference voltage control switch SW1 is switched on in response to a reference voltage control signal PRE to connect an input terminal of a reference voltage Vref and the sensing line 14B. The sampling switch SW2 is switched on in response to a sampling control signal SAM to connect the sensing line 14B and the sample and hold circuit S/H. When the sampling switch SW2 is turned on, the sample and hold circuit S/H samples and holds the source node voltage Vs of the driving TFT DT stored in a line capacitor LCa of the sensing line 14B as a sensing voltage Vsen and then passes it to an ADC. Here, a parasitic capacitor present in the sensing line 14B may be substituted for the line capacitor LCa.

An image display operation for internally compensating for a change in the mobility of the driving TFT will be described below in conjunction with an example configuration of such a pixel and FIG. 6. When a compensation value corresponding to a threshold voltage change is obtained in the compensation operation for sensing a change in threshold voltage, the image display operation is performed based on an image display data voltage reflecting the compensation voltage. A change in the mobility of the driving TFT is not compensated for in the compensation operation but compensated for in the image display operation. Accordingly, in the image display operation, an image is displayed, with the compensation of the changes in both the threshold voltage and mobility of the driving TFT.

The image display operation comprises a initial period Ti, a sensing period Ts, and an emission period Te. During the image display operation, the reference voltage control switch SW1 remains ON to apply the reference voltage Vref to the sensing line 14B, and the sampling switch SW2 remains OFF.

In the initial period Ti, both the scan control signal SCAN and the sensing control signal SEN remain ON. The first switching TFT ST1 is turned on in response to the scan control signal SCAN of ON state to apply an image display data voltage to the gate electrode of the driving TFT DT, and the second switching TFT ST2 is turned on in response to the sensing control signal SEN of ON state and applies a reference voltage Vref to the source electrode of the driving TFT DT.

In the sensing period Ts, the scan control signal SCAN remains ON, and the sensing control signal SEN is inverted to OFF. The first switching TFT ST1 remains ON and holds the voltage at the gate node Ng of the driving TFT DT at the image display data voltage. The second switching TFT ST2 is turned off, whereupon a current corresponding to a gate-source voltage difference Vgs, which is set in the initial period Ti, flows through the driving TFT DT. Accordingly, the voltage at the source node Ns of the driving TFT DT rises toward the image display data voltage applied to the gate electrode of the driving TFT DT according to a source-follower method so that the gate-source voltage difference Vgs of the driving TFT DT is programmed to a desired gray level.

In the emission period Te, both the scan control signal SCAN and the sensing control signal SEN remain OFF. The voltage at the gate node Ng of the driving TFT DT and the voltage at the source node Ns rise to a voltage level equal to or higher than the threshold voltage of the OLED while maintaining the voltage difference Vgs programmed in the sensing period Ts, and then maintain this voltage level. A drive current corresponding to the programmed gate-source voltage difference Vgs of the driving TFT DT flows through the OLED. As a result, the OLED emits light, thereby representing a desired gray level.

As such, a change in the mobility of the driving TFT DT is compensated for based on the principle that the source voltage Vs of the driving TFT DT is raised by capacitive coupling while the gate voltage Vg of the driving TFT DT is fixed at the image display data voltage during the sensing period Ts. The drive current, which determines the light intensity (luminance) of the pixel, is proportional to the mobility μ of the driving TFT DT and the gate-source voltage difference Vgs of the driving TFT DT programmed in the sensing period Ts. During the sensing period Ts, in the case of a pixel with high mobility μ, the source voltage Vs of the driving TFT DT rises at a first rate of rise toward the higher gate voltage Vg so that the gate-source voltage difference Vgs of the driving TFT DT is programmed to be relatively small. On the contrary, during the sensing period Ts, in the case of a pixel with low mobility μ, the source voltage Vs of the driving TFT DT rises at a second rate of rise (which is slower than the first rate of rise) toward the higher gate voltage Vg so that the gate-source voltage difference Vgs of the driving TFT DT is programmed to be relatively large. That is, the gate-source voltage is automatically programmed to be inversely proportional to the degree of mobility. As a result, luminance variations are compensated for differences in mobility μ between pixels.

A compensation operation for compensating a change in the threshold voltage of the driving TFT will be described below in conjunction with the above-described example configuration of a pixel and FIGS. 7A and 7B and FIG. 8.

A compensation operation comprises a first process for obtaining a first sensing voltage Vsen1 during a first compensation period SP1 shown in FIG. 7A, and a second process for obtaining a second sensing voltage Vsen2 during a second compensation period SP2 shown in FIG. 7B. Here, the first compensation period SP1 and the second compensation period SP2 may be placed consecutively within one vertical blanking interval or separately in different vertical blanking intervals.

As shown in FIG. 7, the first compensation period SP1 may comprise a first programming period T2, a first sensing period T4, and a first sampling period T5. The first compensation period SP1 may further comprise a first source node initial period T3 in order to increase sensing accuracy. In FIG. 7A, "T1" is a first sensing line initial period for resetting the sensing line 14B to a reference voltage Vref in advance before the first programming period T2, and may be omitted.

In the first programming period T2, a scan control signal SCAN, sensing control signal SEN, and reference voltage signal PRE are all input as ON. In the first programming period T2, the first switching TFT ST1 is turned on to apply a first data voltage for sensing Vdata1' to the gate node Ng of the driving TFT DT, and the second switching TFT ST2 and the reference voltage control switch SW1 are turned on to apply the reference voltage Vref to the source node Ns of the driving TFT DT. As a result, the gate-source voltage Vg of the driving TFT DT is programmed to a first level LV1. Here, the first data voltage for sensing Vdata1' reflects a threshold voltage component Vth(n−1) of the previous sensing period.

In the first source node initial period T3, the scan control signal SCAN is inverted to OFF, and the sensing control signal SEN and the reference voltage control signal PRE remain ON. In the first source node initial period T3, the first switching TFT ST1 is turned off to make the gate node Ng of the driving TFT DT float, and the second switching TFT ST2 and the reference voltage control switch SW1 are turned on to constantly apply the reference voltage Vref to the source node Ns of the driving TFT DT. As a result, the source node Ns of the driving TFT DT is reset for the second time to the reference voltage Vref while the gate-source voltage Vgs of the driving TFT DT is held at the first level LV1. The reason why the source node Ns of the driving TFT DT is reset for the second time to the reference voltage Vref is because sensing accuracy can be increased by making the voltage at the start point of the first sensing period T4 equal for all pixels.

In the first sensing period T4, the scan control signal SCAN is held at OFF level, the sensing control signal SEN is held at ON level, and the reference voltage control signal PRE is inverted to OFF level. In the first sensing period T4, the first switching TFT ST1 is turned off to keep the gate node Ng of the driving TFT DT floating, and the reference voltage control switch SW1 is turned off to disconnect the source node Ns of the driving TFT DT from an input of the reference voltage Vref. In this state, a pixel current flows through the driving TFT DT by the gate-source voltage Vg of the first level LV1, and the source node voltage Vs of the driving TFT DT rises due to this pixel current. The source node voltage Vs of the driving TFT DT is stored in the line capacitor LCa of the sensing line 14B by the turned-on second switching TFT ST2.

In the first sampling period T5, the sensing control signal SEN is inverted to OFF level, and the sampling control signal SAM is input as ON level. In the first sampling period T5, the second switching TFT ST2 is turned off to release the electrical connection between the source node Ns of the driving TFT DT and the sensing line 14B. Also, the sampling control switch SW2 is turned on to connect the sensing line 14B and the sample and hold circuit S/H, thereby sampling the source node voltage Vs of the driving TFT DT stored in the sensing line 14B as the first sensing voltage Vsen1. The first sensing voltage Vsen1 is converted to a first digital value by an ADC and then stored in an internal latch in the data drive circuit 12.

As shown in FIG. 7B, the second compensation period SP2 may comprise a second programming period T2', a second sensing period T4', and a second sampling period T5'. The second compensation period SP2 may further comprise a second source node initial period T3' in order to increase sensing accuracy. In FIG. 7B, "T1" is a second sensing line initial period for resetting the sensing line 14B to a reference voltage Vref in advance before the second programming period T2', and may be omitted.

In the second programming period T2', a scan control signal SCAN, sensing control signal SEN, and reference voltage signal PRE are all input as ON. In the second programming period T2', the first switching TFT ST1 is turned on to apply a second data voltage for sensing Vdata2' to the gate node Ng of the driving TFT DT, and the second switching TFT ST2 and the reference voltage control switch SW1 are turned on to apply the reference voltage Vref to the source node Ns of the driving TFT DT. As a result, the gate-source voltage Vg of the driving TFT DT is programmed to a second level LV2. Here, the second data voltage for sensing Vdata2' reflects a threshold voltage component Vth(n−1) of the previous sensing period.

In the second source node initial period T3', the scan control signal SCAN is inverted to OFF, and the sensing control signal SEN and the reference voltage control signal PRE remain ON. In the second source node initial period T3', the first switching TFT ST1 is turned off to make the gate node Ng of the driving TFT DT float, and the second switching TFT ST2 and the reference voltage control switch SW1 are turned on to keep applying the reference voltage Vref to the source node Ns of the driving TFT DT. As a result, the source node Ns of the driving TFT DT is reset for the second time to the reference voltage Vref while the gate-source voltage Vgs of the driving TFT DT is held at the second level LV2. The reason why the source node Ns of the driving TFT DT is reset for the second time to the reference voltage Vref is because sensing accuracy can be increased by making the voltage at the start point of the second sensing period T4' equal for all pixels.

In the second sensing period T4', the scan control signal SCAN is held at OFF level, the sensing control signal SEN is held at ON level, and the reference voltage control signal PRE is inverted to OFF level. In the second sensing period T4', the first switching TFT ST1 is turned off to keep the gate node Ng of the driving TFT DT floating, and the reference voltage control switch SW1 is turned off to disconnect the source node Ns of the driving TFT DT from an input of the reference voltage Vref. In this state, a pixel current flows through the driving TFT DT by the gate-source voltage Vg of the second level LV2, and the source node voltage Vs of the driving TFT DT rises due to this pixel current. The source node voltage Vs of the driving TFT DT is stored in the line capacitor LCa of the sensing line 14B by the turned-on second switching TFT ST2.

In the second sampling period T5', the sensing control signal SEN is inverted to OFF level, and the sampling control signal SAM is input as ON level. In the second sampling period T5', the second switching TFT ST2 is turned off to release the electrical connection between the source node Ns of the driving TFT DT and the sensing line 14B. Also, the sampling control switch SW2 is turned on to connect the sensing line 14B and the sample and hold circuit S/H, thereby sampling the source node voltage Vs of the driving TFT DT stored in the sensing line 14B as the first sensing voltage Vsen1. The second sensing voltage Vsen2 is converted to a second digital value by an ADC and then stored in an internal latch in the data drive circuit 12.

The first and second sensing voltages Vsen1 and Vsen2 stored as digital values in the internal latch are transmitted to the timing controller 11. The timing controller 11 calculates the sensing ratio VSR between the first and second sensing voltages Vsen1 and Vsen2, and reads a change ΔVth in the threshold voltage of the driving TFT DT from a look-up table by using a change in sensing ratio—which is obtained by subtracting the sensing ratio VSR from a preset initial sensing ratio VSRinit)—as a read address.

In accordance with example embodiments of the present invention, a change in the threshold voltage of the driving TFT may be accurately sensed by canceling out a change in the mobility of the driving TFT commonly included in the first and second sensing voltages by using a sensing ratio VSR. Further, a threshold voltage change ΔVth may be determined by a change in sensing ratio VSR. Even for pixels having driving TFTs with the same mobility, a change in the threshold voltage Vth of the driving TFT is represented as a difference in slope between the curves in the TFT linear region in which Vgs is lower than Vth. Also, the voltage values in the TFT linear region may be sensed to reduce the time taken for the sensing.

Moreover, in example embodiments of the present invention, since a change in mobility is linearly and internally compensated for during the image display operation, accurate and fast sensing may be done in the TFT linear region during the compensation operation. In cases where fast sensing is done as discussed above without linearly compensating for a change in mobility, a sensing voltage comprises the change in mobility as well as a change in threshold voltage, and the change in mobility has a much greater effect on the sensing voltage, thereby making it possible to precisely detect a change in threshold voltage.

Figure 9:
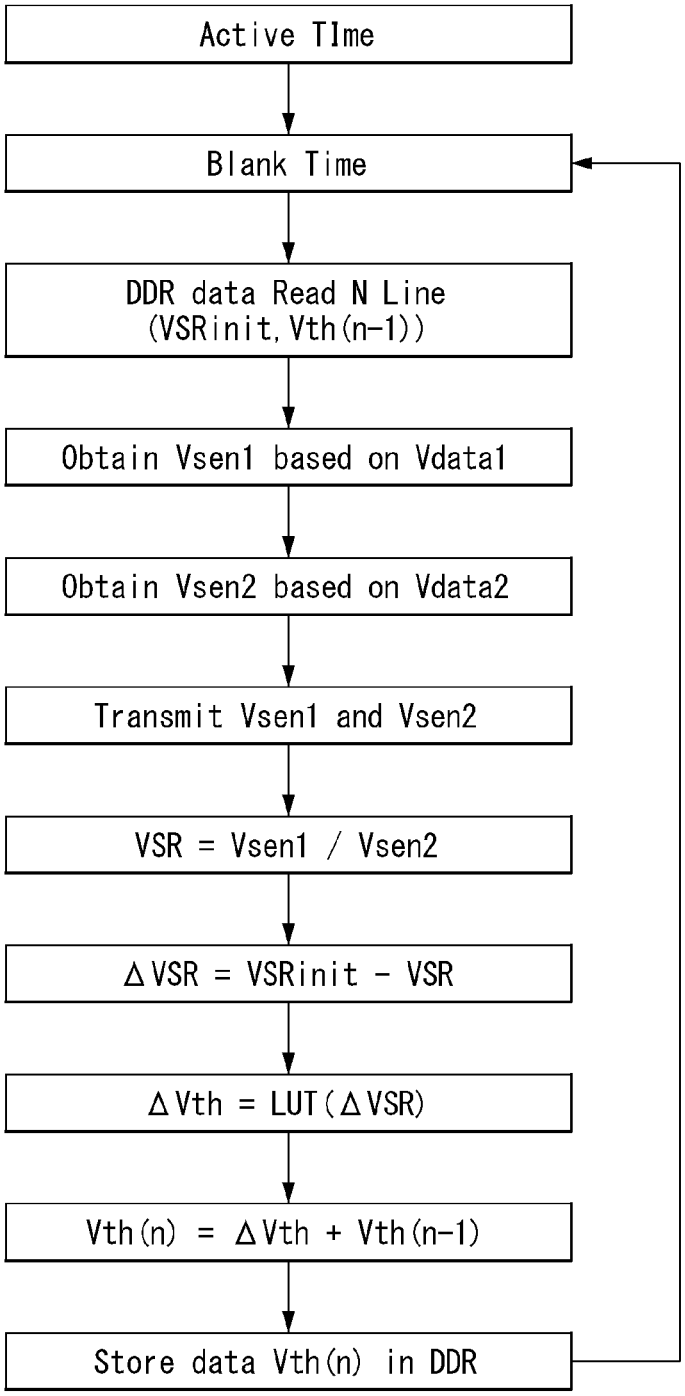
FIG. 9 shows a method for sensing a change in the threshold voltage of the driving TFT according to an example embodiment of the present invention.
Figure 10:
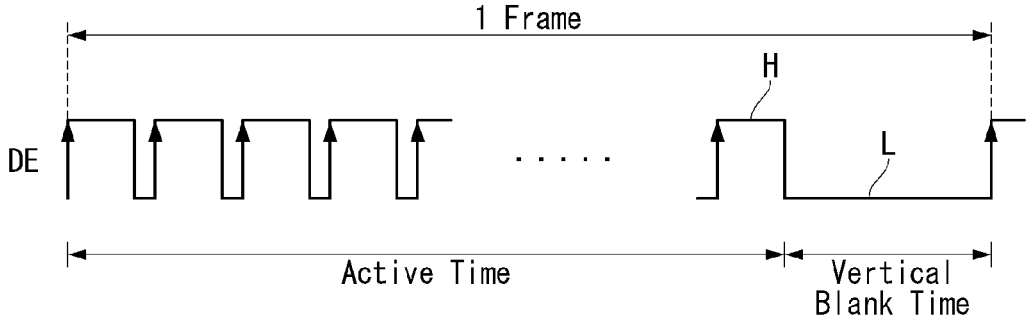
FIG. 10 shows a vertical blanking interval in one frame during which a change in the threshold voltage of the driving TFT is sensed.

FIG. 9 shows a method for sensing a change in the threshold voltage of the driving TFT according to an example embodiment of the present invention. FIG. 10 shows a vertical blanking interval in one frame during which a change in the threshold voltage of the driving TFT is sensed.

With reference to FIG. 9, first and second sensing voltages are obtained by fast sensing in the TFT linear region, and a change in the threshold voltage of the driving TFT is obtained based on the sensing ratio between the sensing voltages. Thus, a number of processes for deducing a change in threshold voltage, such as programming, source node resetting, sensing, and sampling, may be performed during the vertical blanking interval. That is, it is possible to sense a change in the threshold voltage of the driving TFT DT during real-time operation, without the need of arranging a time during power-on or power-off to sense a threshold voltage change, thereby improving compensation performance.

Here, the vertical blanking interval indicates the time between active intervals for image display during which data for image display is not written, as illustrated in FIG. 10. During the vertical blanking interval, a data enable signal DE continues to remain at low logic level L. When the data enable signal DE is at low logic level, data writing is paused.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A device for sensing a threshold voltage of a driving TFT in an organic light emitting display, the device comprising:

a data drive circuit configured to:

apply a first data voltage to a gate node of the driving TFT during a first programming period, determine a source node voltage of the driving TFT as a first sensing voltage during a first sensing period in which a gate-source voltage of the driving TFT is held constant at a first value higher than the threshold voltage of the driving TFT, apply a second data voltage to the gate node of the driving TFT during a second programming period, and determine the source node voltage of the driving TFT as a second sensing voltage during a second sensing period in which the gate-source voltage of the driving TFT is held constant at a second value higher than the threshold voltage of the driving TFT; and a timing controller configured to calculate a sensing ratio based on a ratio between the first and second sensing voltages, calculate a change in the sensing ratio by comparing the calculated sensing ratio with a predetermined initial sensing ratio, and then obtain a change in the threshold voltage of the driving TFT based on the change in the sensing ratio.

2. The device of claim 1, wherein the first programming period and the first sensing period are included in a first compensation period, and the second programming period and the second sensing period are included in a second compensation period, wherein the first and second compensation periods are placed in a vertical blanking interval, and the vertical blanking interval is the time between active intervals for image display, and wherein data for image display is not written during the vertical blanking interval.

3. The device of claim 2, wherein the first and second compensation periods are arranged consecutively in the same vertical blanking interval.

4. The device of claim 2, wherein the first and second compensation periods are placed separately in different vertical blanking intervals.

5. The device of claim 1, wherein the data drive circuit is configured to supply a reference voltage to the source node of the driving TFT during a first initial period between the first programming period and the first sensing period, and supply the reference voltage to the source node of the driving TFT during a second initial period between the second programming period and the second sensing period.

6. The device of claim 1, further comprising a gate drive circuit configured to generate a scan control signal and a sensing control signal, wherein each pixel of the organic light emitting display includes a first switching TFT that is turned on in response to the scan control signal to connect a data line connected to the data drive circuit to the gate node of the driving TFT, a second switching TFT that is turned on in response to the sensing control signal to connect the source node of the driving TFT to a sensing line connected to a sensing unit in the data drive circuit, and a storage capacitor connected between the gate node and source node of the driving TFT, wherein the sensing unit includes a reference voltage control switch that is switched on in response to a reference voltage control signal to connect a reference voltage input terminal and the sensing line, and a sampling control switch that is switched on in response to a sampling control signal to connect the sensing line and a sample and hold circuit, and wherein the scan control signal is applied at an ON level during the first and second programming periods, the sensing control signal is applied at the ON level during the first and second programming periods, the first and second initial periods, and the first and second sensing periods, the reference voltage control signal is applied at the ON level during the first and second programming periods and the first and second initial periods, and the sampling control signal is applied at the ON level during a first sampling period after the first sensing period and a second sampling period after the second sensing period.

7. A method for sensing threshold voltage of a driving TFT in organic light emitting display, the method comprising:

applying a first data voltage for sensing to a gate node of the driving TFT during a first programming period;

determining a source node voltage of the driving TFT as a first sensing voltage during a first sensing period in which a gate-source voltage of the driving TFT is held constant at a first value higher than the threshold voltage of the driving TFT;

applying a second data voltage to the gate node of the driving TFT during a second programming period;

determining the source node voltage of the driving TFT as a second sensing voltage during a second sensing period in which the gate-source voltage of the driving TFT is held constant at a second value higher than the threshold voltage of the driving TFT;

calculating a sensing ratio based on a ratio between the first and second sensing voltages;

calculating a change in sensing ratio by comparing the calculated sensing ratio with a predetermined initial sensing ratio;

obtaining a change in the threshold voltage of the driving TFT based on the change in sensing ratio; and adjusting image data output from the data drive circuit to a pixel driven by the driving TFT in the organic light emitting display device based on the change in the threshold voltage to correct an amount of light emitted by the pixel.

8. The method of claim 7, wherein the first programming period and the first sensing period are included in a first compensation period, and the second programming period and the second sensing period are included in a second compensation period, and wherein the first and second compensation periods are placed in a vertical blanking interval, and the vertical blanking interval is the time between active intervals for image display, wherein data for image display is not written during the vertical blanking interval.

9. The method of claim 8, wherein the first and second compensation periods are placed consecutively in the same vertical blanking interval.

10. The method of claim 8, wherein the first and second compensation periods are placed separately in different vertical blanking intervals.

11. The method of claim 7, further comprising supplying a reference voltage to the source node of the driving TFT during a first initial period between the first programming period and the first sensing period and supplying the reference voltage to the source node of the driving TFT during a second initial period between the second programming period and the second sensing period.

12. An organic light emitting display, comprising:

a display panel including a plurality of pixels, each pixel having an organic light emitting diode (OLED) to emit light and a driving TFT to control an amount of light emitted by the OLED;

a data drive circuit configured to:

apply a first data voltage to a gate node of the driving TFT during a first programming period, determine a source node voltage of the driving TFT as a first sensing voltage during a first sensing period in which a gate-source voltage of the driving TFT is held constant at a first value higher than the threshold voltage of the driving TFT, apply a second data voltage to the gate node of the driving TFT during a second programming period, and determine a source node voltage of the driving TFT as a second sensing voltage during a second sensing period in which the gate-source voltage of the driving TFT is held constant at a second value higher than the threshold voltage of the driving TFT; and a timing controller configured to calculate a sensing ratio based on the ratio between the first and second sensing voltages, calculate a change in the sensing ratio by comparing the calculated sensing ratio with a predetermined initial sensing ratio, and then obtain a change in the threshold voltage of the driving TFT based on the change in the sensing ratio, wherein the data drive circuit is configured to adjust image data output from the data drive circuit to a pixel driven by the driving TFT based on the change in the threshold voltage to correct an amount of light emitted by the pixel.

13. The organic light emitting display of claim 12, wherein the first programming period and the first sensing period are included in a first compensation period, and the second programming period and the second sensing period are included in a second compensation period, wherein the first and second compensation periods are placed in a vertical blanking interval, and the vertical blanking interval is the time between active intervals for image display, and wherein data for image display is not written during the vertical blanking interval.

14. The organic light emitting display of claim 13, wherein the first and second compensation periods are arranged consecutively in the same vertical blanking interval.

15. The organic light emitting display of claim 13, wherein the first and second compensation periods are placed separately in different vertical blanking intervals.

16. The organic light emitting display of claim 12, wherein the data drive circuit is configured to supply a reference voltage to the source node of the driving TFT during a first initial period between the first programming period and the first sensing period, and supply the reference voltage to the source node of the driving TFT during a second initial period between the second programming period and the second sensing period.

17. The organic light emitting display of claim 12, further comprising a gate drive circuit configured to generate a scan control signal and a sensing control signal, wherein each pixel of the organic light emitting display includes a first switching TFT that is turned on in response to the scan control signal to connect a data line connected to the data drive circuit to the gate node of the driving TFT, a second switching TFT that is turned on in response to the sensing control signal to connect the source node of the driving TFT to a sensing line connected to a sensing unit in the data drive circuit, and a storage capacitor connected between the gate node and source node of the driving TFT, wherein the sensing unit includes a reference voltage control switch that is switched on in response to a reference voltage control signal to connect a reference voltage input terminal and the sensing line, and a sampling control switch that is switched on in response to a sampling control signal to connect the sensing line and a sample and hold circuit, and wherein the scan control signal is applied at an ON level during the first and second programming periods, the sensing control signal is applied at the ON level during the first and second programming periods, the first and second initial periods, and the first and second sensing periods, the reference voltage control signal is applied at the ON level during the first and second programming periods and the first and second initial periods, and the sampling control signal is applied at the ON level during a first sampling period after the first sensing period and a second sampling period after the second sensing period.

* * * * *